US005848905A

United States Patent [19]

Patel

[11] Patent Number: 5,848,905

[45] Date of Patent: Dec. 15, 1998

[54] PLUG LOCK

[76] Inventor: Narendra Patel, 295 Saddle Creek La., Roswell, Ga. 30076

[21] Appl. No.: 917,244

[22] Filed: Aug. 25, 1997

[51] Int. Cl.[6] ..... H01R 13/44

[52] U.S. Cl. ..... 439/134

[58] Field of Search ..... 439/133, 134

[56] References Cited

U.S. PATENT DOCUMENTS

| | | | |
|---|---|---|---|
| 4,413,488 | 11/1983 | Harmison | 439/133 |
| 4,640,107 | 2/1987 | Slade | 439/133 |
| 5,055,057 | 10/1991 | Boyer | 439/133 |
| 5,277,600 | 1/1994 | Meixler | 439/134 |

*Primary Examiner*—Neil Abrams
*Assistant Examiner*—T C Patel

[57] ABSTRACT

A plug lock (10) functioning to securely lock a plug (16). The plug lock (10) having a a lock base (12) and a U-member (14). The U-member first shaft (14A) is slidably insertable into the lock base first opening (12BA). The U-member second shaft (14B) is slidably insertable into the lock base second opening (12BB). The U-member first shaft (14A) further comprises a U-member tab (14D) extending therefrom. The U-member tab (14D) comprises an U-member tab first member (14DA) securely connected at a front distal end at a perpendicular angle to a top distal end of an U-member tab cross member (14DC) which is securely connected at a bottom distal end to the U-member first shaft (14A). The U-member (14) is open at a rear end allowing an user to insert a front distal end of the U-member first shaft (14A) through a plug first male member opening (16AA) of a plug first male member (16A) and further inserting through a plug second male member opening (16BA) of a plug second male member (16B) into the lock base first opening (12BA).

7 Claims, 3 Drawing Sheets

PLUG LOCK

FIELD OF THE INVENTION

The present invention relates to safety devices. More particularly, the present invention relates to a locking device for electrical plugs.

DESCRIPTION OF THE PRIOR ART

It is desirable to prevent the use of electrical appliances by small children, elderly persons, and mentally retarded persons from using various electrical appliances found in the home. The potential for injury to these persons is a serious concern. The fire hazard potential from these articles is also a concern. Further at times it is desirable to render inoperable certain pieces of equipment such as a computer, electrical machinery, TVS, VCRs, and other potentially hazardous equipment. While the prior art is crowded with devices which attempt to satisfy this need, all are complex or costly to manufacture and use. Prior art locking devices which capture the plug into a housing by securing to the plug body are not aesthetically pleasing and are awkward and require a size for each size of plug. Alternatively, locking devices, which for their operation, attach through one of the holes in a prong of the plug can result in a shock if the free prong is inserted into a receptacle.

Numerous innovations for Plug Lock have been provided in the prior art that are described as follows. Even though these innovations may be suitable for the specific individual purposes to which they address, they differ from the present invention as hereinafter contrasted.

In Pat. No. 5,427,543, titled Electrical Connector Prong Lock, invented by Gregory G. Dynia, an electrical connector prong lock including a spring loaded insulating pin which is passed through a bearing member affixed to the electrical connector prong lock and through a hole commonly found near the end of a prong of a male electrical plug. A sliding cam member is employed to move the insulating pin member into and out of engagement. In an alternate embodiment the enlarged end of a ground return prong is engaged by a forked insulating member affixed to the electrical connector prong lock thereby preventing prong release.

The patented invention differs from the present invention because the patented invention is a device which functions to securely and removably fasten tow mating electrical plugs together. The purpose is to prevent the two plugs from separating when the electrical cord is pulled. The patented invention lacks the feature of the present invention where a key is required to unlock the device. The patented invention further lacks the feature of the present invention which prevents connecting the electrical plug to a receptacle.

In Pat. No. 5,277,600, titled Electrical Plug Safety Lock, invented by Lewis D. Meixler, an apparatus for securing the prongs of an electrical appliance plug into a block of strong, flexible plastic is described. The block has a pair of grooves spaced at the appropriate distances to accommodate the parallel prongs of a standard electrical plug. Additionally, the block has an aperture to receive the third, or grounding prong of the electrical plug. A hole, receptive of a bolt, exists at right angles to the direction of insertion of the plug. The hole has a clearance region through the middle and the section of the block adjacent to the bolt head, but is threaded at the section which is opposite the bolt head. The bolt is of the appropriate length to traverse the width of the block when fully tightened into the block. Additionally, the hole may be recessed to form a depression around the bolt head to discourage tampering or probing. Similarly, a recessed region may be formed on the face of the block into which the plug is inserted to likewise discourage tampering or probing. In operation, once the plug prongs are inserted into the block, the bolt is tightened, and retentive force is applied to the prongs of the plug to prevent removal. Optionally, a groove may be positioned on the side of the block, and a hole may be located in the end of the bolt. This combination allows the shackle of a padlock to be inserted into the shank of the bolt, to retain the bolt in the block. Once the bolt is tightened into the appropriate position, the padlock shackle is inserted into a hole in the shank. The groove cooperates with the shackle and prevents the loosening of the bolt thereby preventing the release of the plug until the padlock shackle is removed.

The patented invention differs from the present invention because the patented invention is a device for locking the prongs of a plug to prevent insertion in a receptacle. The present invention is a simple locking device requiring only that the shackle of a lock be passed through the holes in the prongs of a plug.

In Pat. No. 5,194,013, titled Lock Plug, invented by Morris Propp, a locking electrical plug is provided which, has a cooperating tool/key, which when rotated in a first direction causes a ground prong extending therefrom to be mechanically expand within a mating female receptacle, thereby preventing inadvertent or accidental removal of the plug from the receptacle, and when rotated in a second direction this again permits the removal of the plug from the receptacle.

The present invention differs from the patented invention because the patented invention is a locking device functioning a plug from easily being removed from a receptacle. The patented invention lacks the feature of preventing the prongs from being inserted into a receptacle.

In Pat. No. 5,082,450, titled Safety Plug with Ground Lock and Prong Locks, invented by Charles C. Warren, Sr. and Shirley J. Warren, an electrical plug for the end of an electrical power cord is described. The plug includes plug prongs and a ground prong, all of which are moveable between retracted and extended positions. The prongs can be locked in the retracted and extended positions, as desired. When the prongs are locked in the retracted position, small children are prevented from attempting to connect the power cord to an electrical outlet. The plug can also be locked in an electrical outlet.

The patented invention differs from the present invention because the patented invention is a safety device which enables the prong of the plug to retract into the body of the plug. This prevents insertion of the plug into an outlet by a small child.

In Pat. No. 5,055,057, titled Electric Plug Lock invented by Paul L. Boyer, a locking device for attachment to the male electric plug on the power supply line to an electric appliance, for the purpose of preventing use of the appliance, comprises a maximum of four separately molded plastic parts, two of which are identical and are secured together to form a housing containing one of the other two components, which is an unitary molded plastic spring locking member. The housing is provided with a pair of slots for receiving the prongs on the electric plug to be locked, and insertion of the prongs into the housing automatically effects the locking action The device can be unlocked only by a key which is separate from the device, and which is the fourth component and is inserted through an opening into the interior of the housing to release the locking action.

The patented invention differs from the present invention because the patented invention is a housing which is provided with a pair of slots for receiving the prongs on the electric plug to be locked. Two spring loaded prongs inside the housing are positioned to engage the holes in the plug prongs and insertion of the prongs into the housing automatically effects the locking action. The device can be unlocked only by a key which is separate from the device. The patented invention lacks the shackle feature of the present invention . Further, the patented invention is more complex.

In Pat. No. 4,679,873, titled Electrical Plug Lock, invented by John R. Brackett, Jr., an electric plug lock is provided for preventing the unauthorized use of an electrically operated appliance which has an electrical cord and plug. It operates by isolating the electrical prongs of the plug in a two part container and then locking the parts together with a conventional padlock.

The patented invention differs from the present invention because the patented invention is a locking cover which fits over the plug enclosing the prongs. The container has a back which is adapted with a notch for the cord. The back further has a forward extending member which passes through the front of the container and is secured with a lock shackle passing through a hole therein. The present invention is a lock having a shackle sized to fit the holes in the ends of an electrical plug prong.

In Pat. No. 4,640,107, titled Safety Lock Apparatus for an Electrical Plug, invented by Luman C. Slade, a safety lock apparatus for an electrical plug is provided which is preferably an integral one-piece plastic member having no moving parts. The apparatus cooperates with a padlock to render the prongs of the plug generally inaccessible within a block of plastic and the plug body is secured by the padlock to the block and/or to a shelf upon which the plug body is seated, a portion of the shelf being received between the padlock body and shackle of the padlock.

The patented invention differs from the present invention because the patented invention lacks the simplicity of the present invention requiring a separate block to encapsulate the prongs of a plug.

In Pat. No. 4,111,509, titled Electric Plug Lock Means, invented by John Novak, a plug for an electrical receptacle outlet having an improved ground prong. The ground prong is supported in the plug body for axial shifting. The end of the prong extending through the plug body is threaded to engage a turn knob and the other end of the ground prong extending from the plug body for insertion in the receptacle is adapted to carry spring filaments which are supported to radially arch by the axial movement of the ground prong in response to the rotation of the knob and thereby secure the plug connected to the receptacle.

The patented invention differs from the present invention because the patented invention is a device to prevent a plug from being pulled out from a receptacle. It is not a locking device to prevent insertion of the plug into a receptacle.

In Pat. No. 5,169,326, titled Electric Plug Lock, invented by Theodore J. Werner, an electric plug combination lock for locking the prongs of an electric plug thereto. The lock includes a casing enclosing a chamber having a lock subassembly therein which has a frame lock portion with lock hooks that lock into holes in the prongs of the electric plug, a spring biasing the frame lock portion to the locked position and a combination lock for preventing the frame lock from entering the unlocked position unless the correct combination is present.

The patented invention differs from the present invention because the patented invention is a casing enclosing a chamber having a lock subassembly therein which has a frame lock portion with lock hooks that lock into holes in the prongs of the electric plug. The patented invention is self locking. A combination is required to remove the patented invention from the prongs of the plug Numerous innovations for Plug Lock have been provided in the prior art that are adapted to be used. Even though these innovations may be suitable for the specific individual purposes to which they address, they would not be suitable for the purposes of the present invention as heretofore described.

SUMMARY OF THE INVENTION

Prongs of an electrical plug are manufactured with an aperture near the tip of each prong. The aperture functions in conjunction with a receptacle to removably attach the plug to an outlet receptacle. The aperture can lend itself to providing an attachment for a locking device which functions to prevent inadvertent use of the electrical appliance attached to the plug.

The types of problems encountered in the prior art are children and unauthorized persons can use electrical appliances.

In the prior art, unsuccessful attempts to solve this problem were attempted namely devices which; encapsulates the plug, are special plugs, and function to removably attach a plug to a receptacle. The unsuccessful attempts resulted in devices that are complex and expensive to manufacture. However, the problem was solved by the present invention because a simple locking device is inserted through the aperture of the prongs in the plug and along with a U-member prevent the plug from mating with a receptacle.

Innovations within the prior art are rapidly being exploited in the field of child protection and baby proofing the home.

It has been found through experimentation that a small lock having a U-member is not sufficient to prevent partial insertion of one prong into a receptacle which could result in a shocking hazard.

The present invention solved a long felt need for a ,simple device, which is easy to use, and prevents a prong of a standard plug from being inserted into a receptacle.

Accordingly, it is an object of the present invention to provide a tamper proof electrical plug.

More particularly, it is an object of the present invention to provide a device which prevents an electrical plug prong from being inserted into an outlet.

In keeping with these objects, and with others which will become apparent hereinafter, one feature of the present invention resides, briefly stated, in a lock base having a key receptacle and locking device contained therein. The locking device receives a U-member which passes through the hole in one of the prongs.

In accordance with another feature of the present invention, a U-member tab prevents the prongs from being partially inserted into a receptacle.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

LIST OF REFERENCE NUMERALS UTILIZED IN THE DRAWINGS

10—plug lock (10)
12—lock base (12)

12A—lock base cylinder (12A)
12AA—lock base cylinder first pin (12AA)
12AB—lock base cylinder second pin (12AB)
12AC—lock base cylinder key (12AC)
12BA—lock base first opening (12BA)
12BB—lock base second opening (12BB)
14—U-member (14)
14A—U-member first shaft (14A)
14AA—U-member first shaft groove (14AA)
14B—U-member second shaft (14B)
14BA—U-member second shaft groove (14BA)
14C—U-member middle (14C)
14D—U-member tab (14D)
14DA—U-member tab first member (14DA)
14DB—U-member tab second member (14DB)
14DC—U-member tab cross member (14DC)
16—plug (16)
16A—plug first male member (16A)
16AA—plug first male member opening (16AA)
16B—plug second male member (16B)
16BA—plug second male member opening (16BA)

DESCRIPTION OF THE PREFERRED EMBODIMENT

Figure 1:
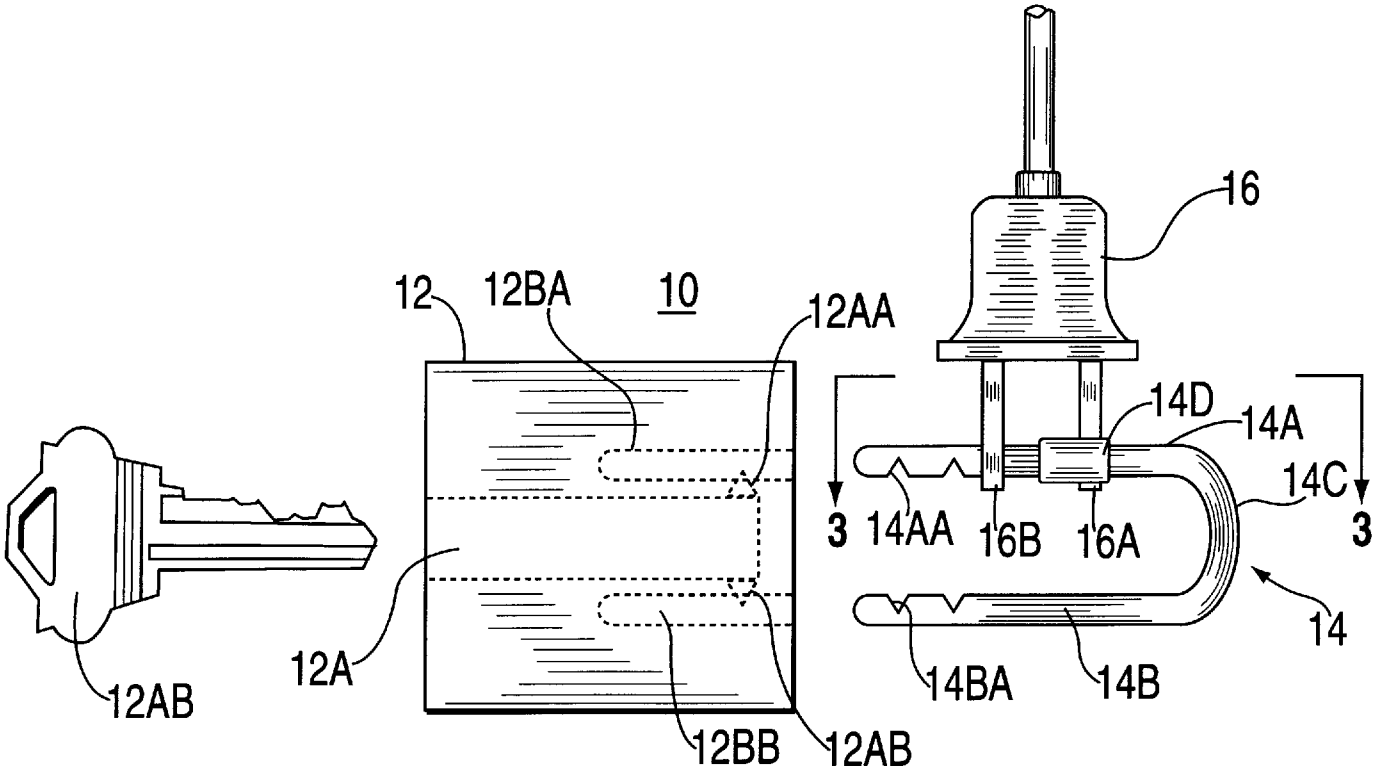
FIG. 1 is an exploded view of a plug lock.
Figure 2:
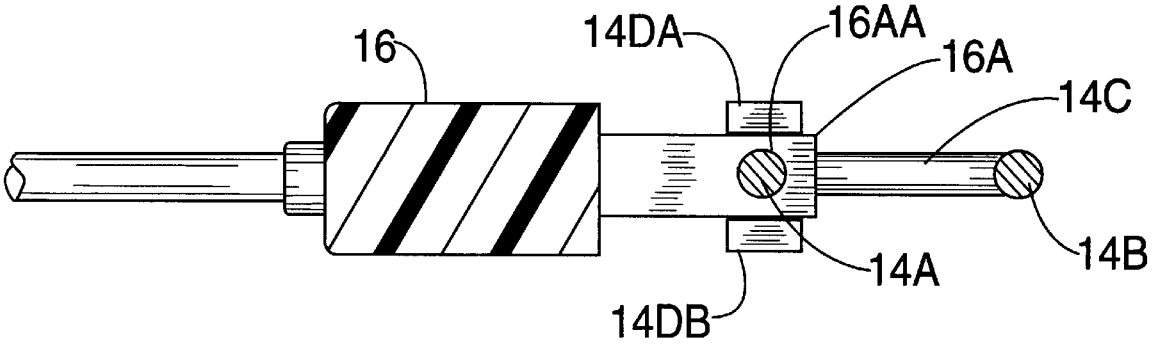
FIG. 2 is a cross section view of a plug lock
Figure 3:
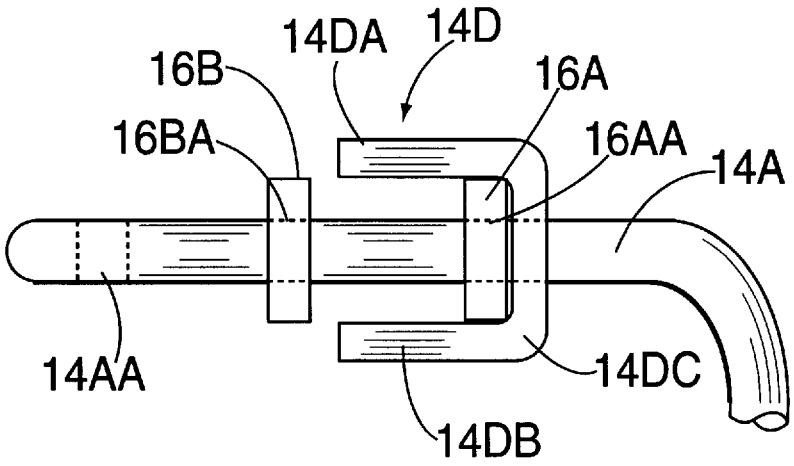
FIG. 3 is an end view of a U-member attached to a plug first male member and a plug second male member.

Now, referring to FIG. 1, FIG. 2, and FIG. 3 together, a plug lock (10) functions to securely lock a plug (16). The plug lock (10) comprises a lock base (12) which comprises a lock base cylinder (12A) having at least one lock base cylinder first pin (12AA) movably disposed therein. When an user inserts a lock base cylinder key (12AC) into the lock base cylinder (12A) and rotates the lock base cylinder (12A) the at least one lock base cylinder pin (12AA, 12AB) extends and retracts perpendicularly therefrom.

The lock base (12) further comprises a lock base first opening (12BA) and a lock base second opening (12BB). The lock base cylinder second pin (12AB) is movable positioned opposite the lock base cylinder first pin (12AA) on the lock base cylinder (12A). The lock base cylinder second pin (12AB) is positioned opposite a U-member second shaft (14B). The U-member second shaft (14B) comprises at least one U-member second shaft groove (14BA) within which the lock base cylinder second pin (12AB) removably engages. The at least one lock base cylinder pin (12AA) is positioned opposite a U-member first shaft (14A). The U-member first shaft (14A) comprises at least one U-member first shaft groove (14AA) within which the lock base cylinder first pin (12AA) removably engages.

The plug lock (10) further comprises a U-member (14) which comprises a U-member first shaft (14A) having at least one U-member first shaft groove (14AA) therein. The U-member (14) further comprises a U-member second shaft (14B) connected to the U-member first shaft (14A) by a U-member middle (14C). The U-member middle (14C) having sufficient length to provide space between the U-member first shaft (14A) and the U-member second shaft (14B) of at least 1.5 centimeters. The U-member first shaft (14A) is slidably insertable into the lock base first opening (12BA). The U-member first shaft (14A) comprises a diameter in the range from 1 to 2.75 mm. The U-member first shaft (14A) and the U-member second shaft (14B) comprise a length of at least 2 centimeters. The U-member second shaft (14B) is slidably insertable into the lock base second opening (12BB).

The U-member first shaft (14A) further comprises a U-member tab (14D) extending therefrom. The U-member tab (14D) comprises an U-member tab first member (14DA) securely connected at a front distal end at a perpendicular angle to a top distal end of an U-member tab cross member (14DC) which is securely connected at a bottom distal end to the U-member first shaft (14A). The U-member tab (14D) further comprises a U-member tab second member (14DB) positioned oppositely from the U-member tab first member (14DA). The U-member tab second member (14DB) is securely fastened to a second distal end of the U-member tab cross member (14DC) which is securely fastened in a middle to the U-member first shaft (14A). The U-member tab second member (14DB) functions to cradle an opposite side of the plug first male member (16A) preventing rotation. The U-member (14) is open at a rear end allowing an user to insert a front distal end of the U-member first shaft (14A) through a plug first male member opening (16AA) of a plug first male member (16A) and further inserting through a plug second male member opening (16BA) of a plug second male member (16B) into the lock base first opening (12BA) wherein the lock base cylinder first pin (12AA) securely engages the U-member first shaft groove (14AA). The U-member tab (14D) cradles the plug first male member (16A) functioning to prevent rotation and exposure of distal ends of the plug first male member (16A) and the plug second male member (16B) from insertability into a female receptacle.

The plug lock (10) is manufactured from a material selected from a group consisting of metal, metal alloy, plastic, plastic composite, rubber composite, fiberglass, epoxy, and carbon-graphite.

It will be understood that each of the elements described above, or two or more together, may also find an useful application in other types of constructions differing from the type described above.

While the invention has been illustrated and described as embodied in a Plug Lock it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A plug lock (10) functioning to securely lock a plug (16), the plug lock (10) comprising:

A) a lock base (12) which comprises a lock base cylinder (12A) having at least one lock base cylinder first pin (12AA) movably disposed therein, when an user inserts a lock base cylinder key (12AC) into the lock base cylinder (12A) and rotates, the at least one lock base cylinder pin (12AA, 12AB) extends and retracts perpendicularly therefrom, the lock base (12) further comprises a lock base first opening (12BA) and a lock base second opening (12BB); and B) a U-member (14) which comprises a U-member first shaft (14A) having at least one U-member first shaft groove (14AA) therein, the U-member (14) further comprises a U-member second shaft (14B) connected to the U-member first shaft (14A) by a U-member middle (14C), the U-member first shaft (14A) is slidably insertable into the lock base first opening (12BA), the U-member second shaft (14B) is slidably insertable into the lock base second opening (12BB), the U-member first shaft (14A) further comprises a U-member tab (14D) extending therefrom, the U-member tab (14D) comprises an U-member tab first member (14DA) securely connected at a front distal end at a perpendicular angle to a top distal end of an U-member tab cross member (14DC) which is securely connected at a bottom distal end to the U-member first shaft (14A), the U-member (14) is open at a rear end allowing an user to insert a front distal end of the U-member first shaft (14A) through a plug first male member opening (16AA) of a plug first male member (16A) and further inserting through a plug second male member opening (16BA) of a plug second male member (16B) into the lock base first opening (12BA) wherein the lock base cylinder first pin (12AA) securely engages the U-member first shaft groove (14AA), the U-member tab (14D) cradles the plug first male member (16A) functioning to prevent rotation and exposure of distal ends of the plug first male member (16A) and the plug second male member (16B) from insertability into a female receptacle.

2. The plug lock (10) as described in claim 1, wherein the lock base cylinder (12A) further comprises a lock base cylinder second pin (12AB) movable positioned therein opposite the lock base cylinder first pin (12AA) and the U-member second shaft (14B) comprises at least one U-member second shaft groove (14BA) within which the lock base cylinder second pin (12AB) removably engages.

3. The plug lock (10) as described in claim 1, wherein the U-member tab (14D) further comprises a U-member tab second member (14DB) positioned oppositely from the U-member tab first member (14DA), the U-member tab second member (14DB) is securely fastened to a second distal end of the U-member tab cross member (14DC) which is securely fastened in a middle to the U-member first shaft (14A), the U-member tab second member (14DB) functions to cradle an opposite side of the plug first male member (16A) preventing rotation.

4. The plug lock (10) as described in claim 1, wherein the U-member first shaft (14A) comprises a diameter in the range from 1 to 2.75 mm.

5. The plug lock (10) as described in claim 1, wherein the U-member first shaft (14A) and the U-member second shaft (14B) comprise a length of at least 2 centimeters.

6. The plug lock (10) as described in claim 5, wherein the U-member middle (14C) having sufficient length to provide space between the U-member first shaft (14A) and the U-member second shaft (14B) of at least 1.5 centimeters.

7. The plug lock (10) as described in claim 1 is manufactured from a material selected from a group consisting of metal, metal alloy, plastic, plastic composite, rubber composite, fiberglass, epoxy, and carbon-graphite.

* * * * *